US005333332A

United States Patent [19]

Kam

[11] Patent Number: 5,333,332

[45] Date of Patent: Aug. 2, 1994

[54] DUAL FLUSH SYSTEM

[75] Inventor: Mok S. Kam, Selangor, Malaysia

[73] Assignee: Vogue Vanity SDN BHD, Malaysia

[21] Appl. No.: 855,315

[22] Filed: Mar. 23, 1992

[51] Int. Cl.[5] ..... E03D 1/35; E03D 3/12

[52] U.S. Cl. ..... 4/326; 4/388; 4/395; 4/397; 4/415

[58] Field of Search ..... 4/324, 325, 326, 327, 4/388, 389, 395, 396, 397, 400, 410, 415

[56] References Cited

U.S. PATENT DOCUMENTS

| | | | |
|---|---|---|---|
| 1,568,346 | 1/1926 | Ryan | 4/388 |
| 3,701,169 | 10/1972 | Kamphausen | 4/400 |
| 4,173,801 | 11/1979 | Bresnyan | 4/326 |
| 4,566,140 | 1/1986 | Musgrove | 4/324 |

FOREIGN PATENT DOCUMENTS

| | | | |
|---|---|---|---|
| 0401431 | 11/1967 | Australia | 4/400 |
| 1530490 | 11/1978 | United Kingdom | 4/326 |

*Primary Examiner*—William A. Cuchlinski, Jr.
*Assistant Examiner*—W. Morris Worth
*Attorney, Agent, or Firm*—Pearne, Gordon, McCoy & Granger

[57] ABSTRACT

A selective volume flush apparatus (10) for use in a cistern contains two valves, a first valve (12) with an outlet opening into the discharge outlet of the cistern and an open end configured to sealingly engage a first valve seal (18). The valve seal (18) is attached to a lifting device (22) and the open end of the valve (12) is positioned at a height from the cistern floor to facilitate the flush of a smaller quantity of water. The second valve 14 includes a diaphragm 26 positioned slidingly movable in a cylinder and attached to a valve seal (20) at the lower end and to a lifting device (24) at the upper end. The valve seal sealingly engages upon an outlet opening 68 connected to the discharge outlet (28) of the cistern. Activating the second valve seal results in a full volume flush.

6 Claims, 5 Drawing Sheets

DUAL FLUSH SYSTEM

BACKGROUND OF THE INVENTION

The present invention relates to a flush apparatus and in particular to a dual flush apparatus for use in a cistern. Selective volume flush apparatus used in cisterns are known to the art wherein it is possible to selectively flush a small quantity or a large quantity of water from the cistern tank. In the prior art models, it is not possible to effect a half flush immediately after effecting a half flush. One has to wait for the water to reach a certain level in the cistern tank before the next flush can be effected. This causes inconvenience to users at times.

SUMMARY OF THE INVENTION

It is an object of the present invention to provide a selective volume flush apparatus in which two flush valve seals are provided to selectively discharge predetermined quantities of water.

It is another object of the present invention to provide a selective volume flush apparatus in which each flush valve seal is independently operated by activating lever mechanisms.

It is still another object of the invention to provide a selective volume flush apparatus in which the activating lever mechanisms to operate the flush valve seals are adjustable to depend on the volumetric size of the cistern.

It is yet another object of the invention to provide a selective volume flush apparatus in which two small volume flushes can be effected immediately one after another provided that the full flush button is activated after the half flush is completed.

Object and advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, arrangements, combinations, steps and improvements herein shown and described.

According to one aspect of the present invention there is disclosed a selective volume flush apparatus for use in cistern mechanisms, said apparatus comprising a first valve with an outlet opening into the discharge outlet of the cistern and an open end configured to sealingly engage a first valve seal, said valve seal is attached to a lifting means, the said open end of the valve positioned at a predetermined weight from the cistern floor; a second valve with an opening at the base to receive part of the valve seal and an open top, valve configured to receive a slidingly movable diaphragm, said diaphragm fastened to a second flush valve seal at the lower surface and to a lifting means at the upper surface; the said second flush valve seal to sealingly engage upon an outlet opening connected to the discharge of the cistern.

In still another aspect of the invention the flush valve seal comprises of drum with a resiliently malleable fin fastened to the drum, the buoyancy of the drum and said fin is pre-determined such as to drop at a pre-determined rate.

The lifting means to lift the flush valve seals include a height adjustable means to facilitate the use of the invention in cistern containers of varying dimensions.

The accompanying drawings, referred to herein and constituting a part hereof, illustrate preferred embodiments of the product of the present invention, and together with the description serve to explain the principles of the invention.

DESCRIPTION OF THE DRAWINGS

Figure 1:
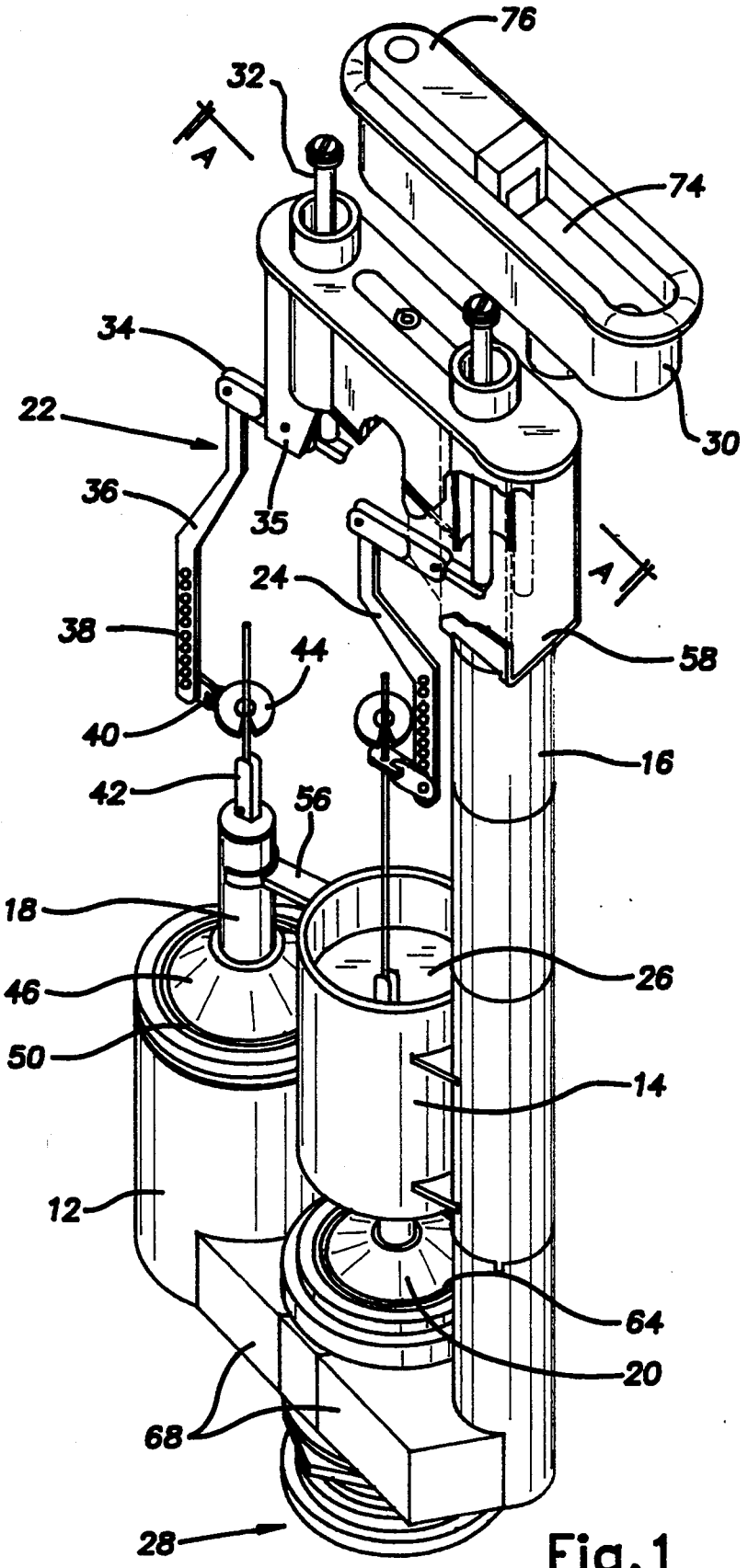
FIG. 1 is a schematic perspective view of the apparatus of the preferred embodiment.

Refering now more particularly to FIGS. 1–5 of the accompanying drawings, there is illustrated a first preferred embodiment of a selective volume flush apparatus indicated generally by reference numeral 10. As here embodied, apparatus 10 includes a first valve 12, a second valve 14, an overflow duct 16, a first flush valve seal 18, a second flush valve seal 20, a first lifting means 22, a second lifting means 24 and a diaphragm 26.

The first valve 12 is preferably an open-ended cylinder the base of which opens into the discharge outlet 28 of the cistern.

The distance of the open end of the first valve 12 from the floor of cistern tank determines the volume of water to be discharged in a small volume flush. It will be understood that substantially all the water above the level of the open end will be discharged when the flush seal valve 18 is operated. Thus the higher the position of the open end of the first valve the smaller the volume of water that will be discharged. Conversely, the lower the position of the open end of the first cylinder 12, the larger the volume of water that will be discharged in a small flush.

Figure 2:
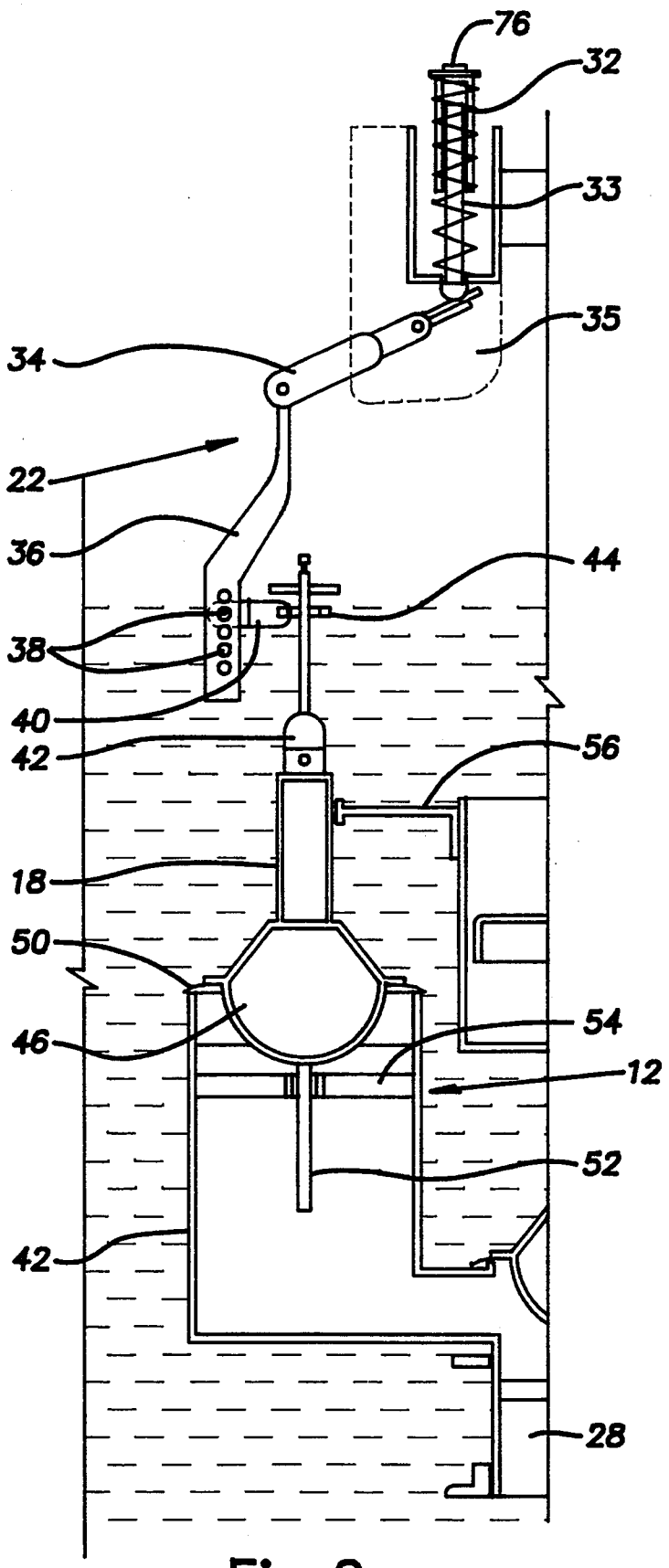
FIG. 2 is a schematic perspective view of the small volume flush apparatus in a sealed position.
Figure 3:
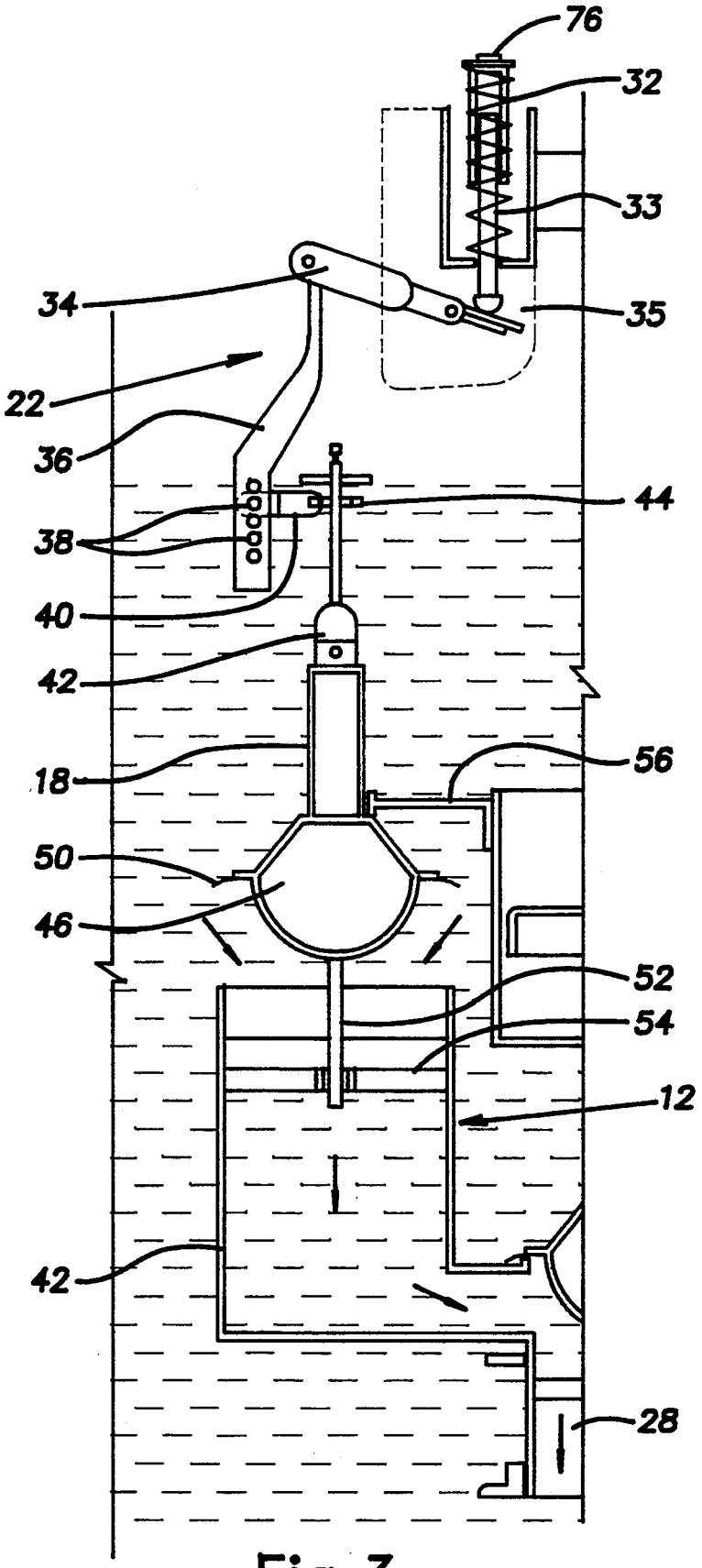
FIG. 3 is a schematic perspective view as in FIG. 2 but in an open position.
Figure 4:
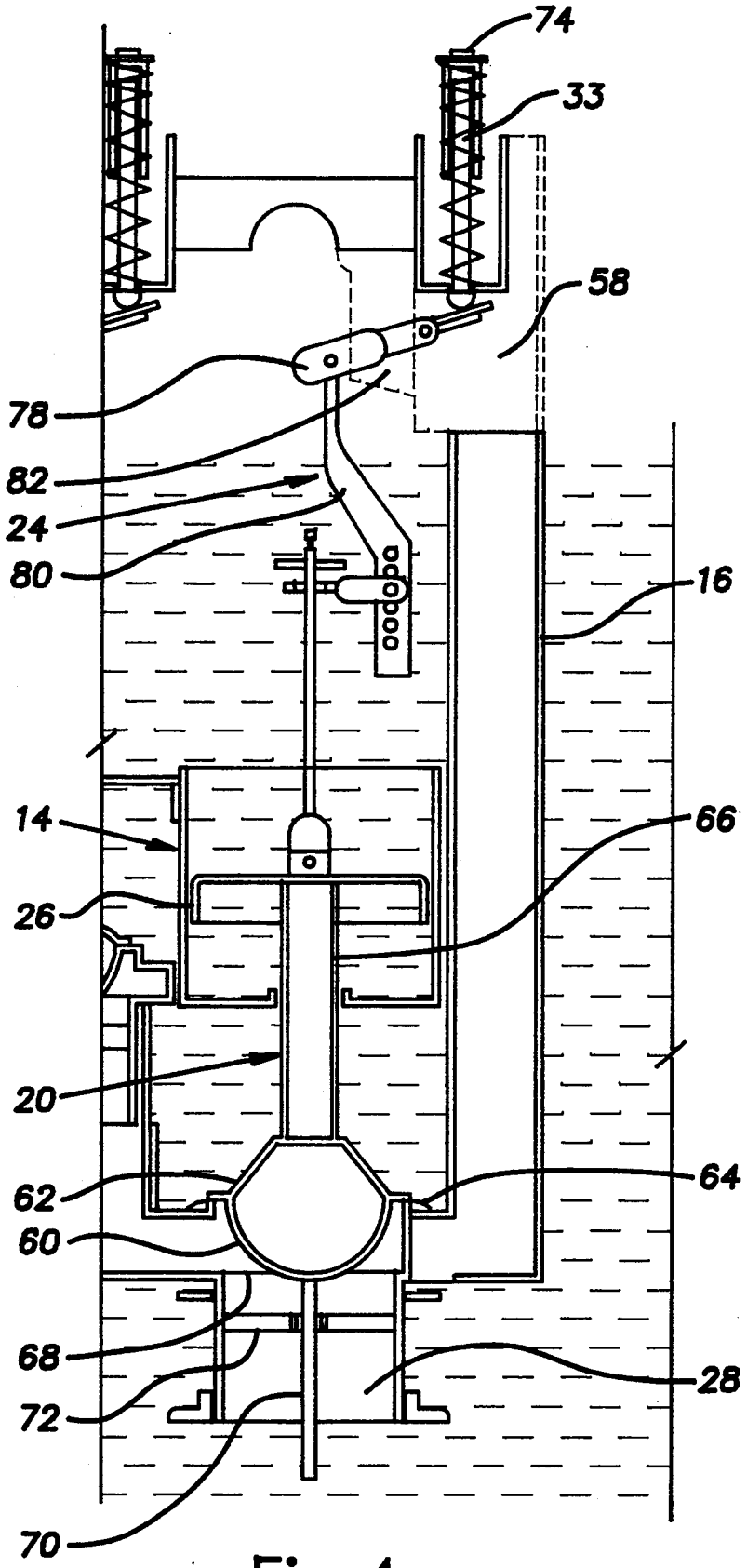
FIG. 4 is a schematic perspective view of the full volume flush apparatus in a sealed position.
Figure 5:
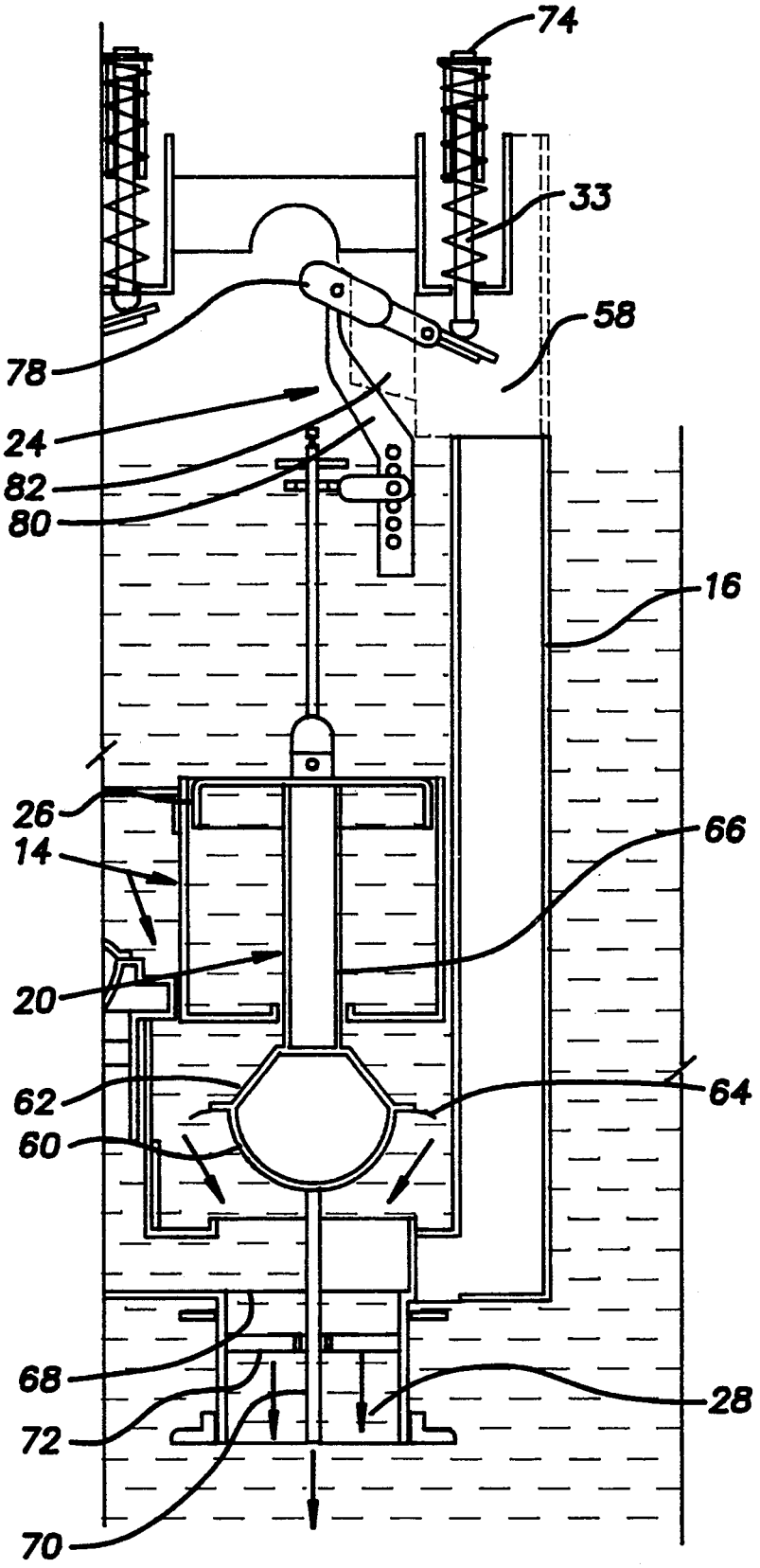
FIG. 5 is a schematic perspective as in FIG. 4 but in an open position.

The first lifting means 22 of the preferred embodiment will now be described. Referring to FIGS. 1, 2 and 3 the application of force on knob 76 against spring bias 32 results in one end of the lever arm 34 pushed down thereby lifting the flush valve seal 18. In the preferred embodiment of first connecting member 36 has a plurality of holes 38. The second connecting member 40 includes a annular bore to facilitate the movement of the said second connecting member 40 in a sliding manner along the vertical limb 42 of the flush valve seal. A suitable restraining means, for example a cross-bar 44 is fastened to the free end of the vertical limb 42 to facilitate the lifting of the flush valve seal.

The flush valve seal comprises of a drum body 46 preferably consisting a lower hemispherical body and an upper conical body. A peripheral washer 50 of resiliently malleable material, preferably Neoprene rubber, is fastened to the drum body. The upper portion of the drum body includes a tubular member 18 which is fastened to the vertical limb 42. To facilitate the correct registration of the washer 50, upon the open end of the first valve 12, there are advantageously provided guide means. The guide means consist of longitudinal rod 52 fastened co-axially to the hemispherical portion, said rod to slidingly move inside a holder ring 54. Advantageously the guide means also includes another bracket 56 which guides the sliding movement of the drum body 46 along a pre-determined vertical direction. It is obvious that the washer 50 would be of sufficient dimension to fit sealingly over the open end of the valve so as to shut-off the flow of water.

Referring in particular to FIG. 2 and 3 the operation of the flush system to effect discharge of small volume of water will be described. On application of downward pressure on the knob 76 against a biasing means, preferably a spring 32, results in the vertical rod 33 extended below, in turn lifting the valve seal 18, via the connecting rods 34, 36. The connecting rod 34 is pivoted to a pivot arm 35. Water in the cistern tank then flows into the first valve 12, then into the discharge outlet 28. It is obvious that only water above the valve level will be discharged. As the water flows into the valve the valve seal drops down by gravitational force gradually to eventually close the valve opening in a sealing manner. The weight and displacement volume of the valve seal is determined by the required buoyancy of the valve seal. In the present invention the weight of the valve seal is 26.4 g. wt. and has a displacement of approximately 65 g. wt. of water. The weight and the displacement volume of the valve seal can be determined for a given quantity of water to be flushed, cistern tank size and time within which the water is to be discharged. The part of the apparatus for the full flush system will now be described with reference to FIGS. 1, 4 and 5. A second valve 14 includes a hollow tubular body with an open upper end and a closed lower base, the base includes an opening to receive a portion of the second valve seal means. The valve 14 is suitably attached in the cistern tank, preferably to a over flow duct 16. The apparatus for the lifting means 24 is similar in structure and configuration to the lifting means apparatus 22 earlier described in detail. In the preferred embodiment, the housing consisting of the spring bias means is advantageously connected to the overflow duct 16 by a connecting rod 58.

The flush valve seal 20 is preferably of similar configuration and structure to the flush valve seal 18 earlier described. The valve 14 includes an inverted cup-shaped body 26 whose external dimensions are marginally smaller than the internal dimensions of the hollow tubular body of the second valve 14 and is structured to move downward and upward co-axial to the valve 14. The flush valve seal 20 is of similar configuration and structure to first flush valve seal 18. The flush valve seal comprises of a drum body 20 preferably consisting a lower hemispherical body 60 and an upper conical body 62. A peripheral washer 64 of resiliently malleable material preferably Neoprene rubber, is fastened to the drum body. The upper conical portion of the drum body includes a tubular member 66 connected to the cup-shaped body through the opening in the base of the hollow tubular body. To facilitate the correct registration of the washer 64 upon the open end 68 of the discharge outlet 28, there is advantageously provided guide means. The guide means consist of a longitudinal rod 70 fastened co-axially to the hemispherical portion, said rod to slidingly move inside a ring 72. The washer 64 is of sufficient dimension to fit sealingly over the open end 68 of the discharge outlet.

The open end 68 of the discharge outlet is preferably positioned at the base of the cistern tank. The operation of the apparatus for the full flush system will now be described with reference to FIGS. 4 and 5. On application of downward pressure on the knob 74 against the biasing means result in the vertical rod 33 extended below, in turn lifting the valve seal 20, via connecting rods 78, 80. The connecting rod 78 is pivoted to a pivot arm 82. Water in the cistern tank flows into the discharge outlet 28. On the release of pressure on the knob 74, the valve seal 20 sinks downward so as to sealingly engage upon the opening of the discharge outlet (28). The cup-shaped body 26 fastened to the valve seal increases buoyancy and in cooperation with the tubular member 66 and the opening in the base of the hollow tubular body reduces the speed of drop of the valve seal so as to permit the discharge of pre-selected volume of water before the discharge is sealingly closed. The flush valve drops downwards by gravitational force. The weight and the displacement volume of the diaphragm and the weight and displacement volume of the second valve seal are again determined by the quantity of water to be flushed, cistern tank size and the time within which the water is to be discharged. In the present invention the weight of the flush valve seal including the diaphragm is 39.7 g. wt. and the displacement is approximately 135 g.wt. of water whereas the amount of water discharged is 9 liter.

The preferred embodiment of the apparatus includes a overflow duct (16), wherein the outlet is conveniently connected to the discharge outlet 28. In another aspect, the overflow duct 16 is incorporated as part of the structure linking the valve 14 and the pivot arm 82. This improves the overall structure and configuration of the apparatus.

In the preferred embodiment of the present invention the apparatus for the small volume and large volume flush are positioned adjacent to each other to provide a compact assembly. The activation knobs 76, 74 can be placed adjacent to each other or can be placed spaced apart the option being dictated by aesthetic factors. The fitting of the discharge outlet 28 to the base of the cistern tank is accomplished by conventional method. The control of the water level inside the cistern tank is also accomplished by known conventional methods for example, ball float mechanism.

To the extent not already indicated, it also will be understood by those ordinarily skilled in the art that the specific embodiment herein described and illustrated may be further modified to incorporate features as described therein. The invention in its broader aspects therefore is not limited to the specific embodiments therein shown and described but departures may be made therefrom within the scope of the accompanying claims, without departing from the principles of the invention and without sacrificing its chief advantages.

I claim:

1. A selective volume liquid flush apparatus for use in a cistern having a floor and a drain, said apparatus comprising:

a first flush valve having an outlet communicating with said drain and an inlet, said first valve inlet being positioned at a predetermined height from the cistern floor;

a first valve seal, configured to sealingly engage said first valve inlet;

a first lifting means attached to said first valve seal for lifting said first valve seal from sealing engagement with said first valve inlet;

a second flush valve having an outlet communicating with said discharge outlet, an inlet, and a hollow upper portion having a closed base with an opening therethrough, said second valve inlet being positioned at a predetermined height from the cistern floor less than the predetermined height of said first valve inlet;

a second valve seal configured to sealingly engage said second valve inlet;

a slidingly movable buoyant body having a lower and upper surface, said buoyant body being received in said upper hollow portion, said lower surface of said buoyant body being fastened at one end of a tubular member, said tubular member being slidably movable through the opening in the closed base and fastened at a second end to said second flush valve seal; and a second lifting means fastened to said upper surface of said buoyant body for lifting said second valve seal from sealing engagement with said second valve inlet.

2. An apparatus according to claim 1, wherein the first valve seal includes a drum with a resiliently malleable fin fastened around the drum, the buoyancy of the drum and said fin being pre-determined such as to drop at a pre-determined rate thereby allowing the discharge of a fixed quantity of liquid from the cistern.

3. An apparatus according to claim 1, wherein the first and second lifting means each include a height adjusting means fastened between the lifting means and the respective flush valve seal to facilitate the use of the flush apparatus in cistern containers of varying dimensions and to facilitate variance of the quantity of water flushed at one time.

4. An apparatus according to claim 1, wherein said buoyant body provides increased buoyancy for the combination of the second valve seal and the diaphragm.

5. An apparatus according to claim 1, further comprising an overflow means for discharging excess liquid from said cistern and a discharge manifold communicating with said drain, said overflow means having an inlet and an outlet, and said overflow outlet, said first valve outlet, and said second valve outlet all communicating with said manifold and being integral therewith.

6. An apparatus according to claim 5, wherein the overflow means includes a hollow cylindrical duct supporting the first and second lifting means.

* * * * *